US005617583A

United States Patent [19]

Yates et al.

[11] Patent Number: 5,617,583

[45] Date of Patent: Apr. 8, 1997

[54] THERMAL GLOVE WITH HEATER POCKET

[76] Inventors: James W. Yates, Rt. 1, Box 585; Ronnie L. Yates, Box 3441, both of Wise, Va. 24293

[21] Appl. No.: 620,085

[22] Filed: Mar. 21, 1996

Related U.S. Application Data

[63] Continuation-in-part of Ser. No. 369,112, Jan. 5, 1995, Pat. No. 5,509,143.

[51] Int. Cl.[6] ..... A41D 19/00

[52] U.S. Cl. ..... 2/160; 2/158

[58] Field of Search ..... 2/158, 159, 160, 2/161.1, 161.5, 161.6, 163, 162

[56] References Cited

U.S. PATENT DOCUMENTS

| | | | |
|---|---|---|---|
| 1,970,081 | 8/1934 | Eisendrath | 2/158 |
| 3,403,408 | 10/1968 | Helfer | 2/158 |
| 4,543,671 | 10/1985 | Monk | 2/158 |
| 4,651,350 | 3/1987 | Dawiedczyk . | |
| 4,933,992 | 6/1990 | Kallman | 2/158 |
| 5,230,333 | 7/1993 | Yates et al. . | |
| 5,509,143 | 4/1996 | Yates et al. | 2/160 |
| 5,515,547 | 5/1996 | Middleton | 2/158 |

*Primary Examiner*—C. D. Crowder
*Assistant Examiner*—Larry D. Worrell, Jr.
*Attorney, Agent, or Firm*—Laubscher & Laubscher

[57] ABSTRACT

A thermal glove includes a cap that is connected with the glove body by a flexible strip for displacement from a stored position adjacent the back of the glove to an operative position in which the cap encloses the finger portions of the glove. The cap contains an interior pocket for receiving a heating device, thereby to heat the glove finger portions. The back portion of the glove body includes a storage pocket for partially receiving the cap and the flexible strip when the cap is displaced to the stored position adjacent to the back portion of the glove body.

10 Claims, 3 Drawing Sheets

THERMAL GLOVE WITH HEATER POCKET

CROSS REFERENCE TO RELATED APPLICATION

This application is a continuation-in-part application of the earlier patent application Ser. No. 08/369,112 filed Jan. 5, 1995, U.S. Pat. No. 5,509,143, by the same inventors entitled "Heated Glove".

BACKGROUND OF THE INVENTION

1. Field of the Invention

A thermal glove includes a cap portion that is connected with the glove body by a flexible strip of material for displacement from a stored position to an operative position in which the cap encloses the finger portions of the glove, the cap containing an internal pocket for receiving a heating device, thereby to heat the glove finger portions.

2. Brief Description of the Prior Art

It is known in the prior art to provide pockets on articles of clothing for receiving a heating device, such as a chemical-type heating pouch, as evidenced by the co-inventors' prior U.S. Pat. No. 523,033, and the Madnick U.S. Pat. No. 4,587,672, Monk U.S. Pat. No. 4,543,671 and Eisendrath U.S. Pat. No. 1,970,081.

As shown by the Daweidczyk U.S. Pat. No. 4,651,350, it is also known in the glove art to provide a glove having a hand portion and a cap portion pivotally connected for movement relative to the hand portion to cover and uncover the tips of the user's fingers that extend outwardly from the glove hand portion.

The present invention was developed to provide a thermal glove in which the glove body includes a plurality of finger portions for completely receiving the wearer's fingers, and means including a moveable cap carrying a heating device for heating the finger portions of the glove body.

SUMMARY OF THE INVENTION

Accordingly, a primary object of the present invention is to provide a thermal glove including a body having finger and thumb portions, and a cap connected with the glove body by a flexible strip of material for displacement from a stored position to an operative position in which the cap encloses the finger portions of the glove body, said cap containing an interior pocket for receiving a heating device, thereby to heat the finger portions of the glove body.

Another object of the invention is to provide means for retaining the cap in a stored position adjacent to the back portion of the glove body.

A further object is to provide a storage pocket on the back portion of the glove for receiving, when the cap is in the stored position, the mouth region of the heater pocket opening and the connecting strip, thereby to protect the pocket when the cap is in the stored position.

BRIEF DESCRIPTION OF THE DRAWINGS

Other objects and advantages of the invention will become apparent from a study of the following specification, when viewed in the light of the accompanying drawings, in which.

DETAILED DESCRIPTION

Figure 1:
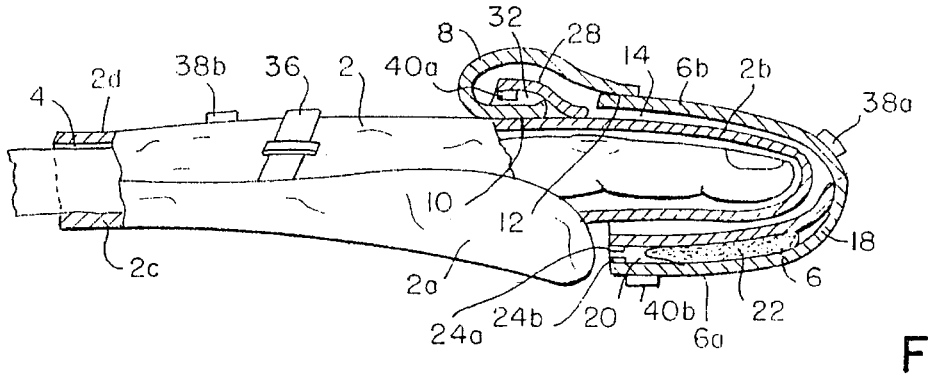
FIG. 1 is a partly broken away side elevational view of the thermal glove of the present invention.
Figure 2:
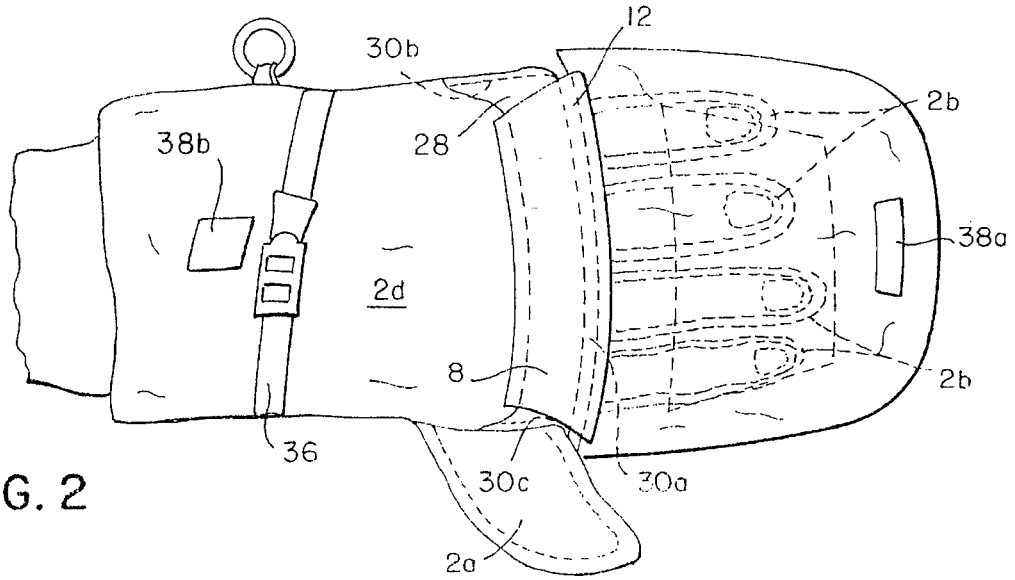
FIGS. 2 and 3 are top and bottom plan views of the thermal glove of FIG. 1.
Figure 3:
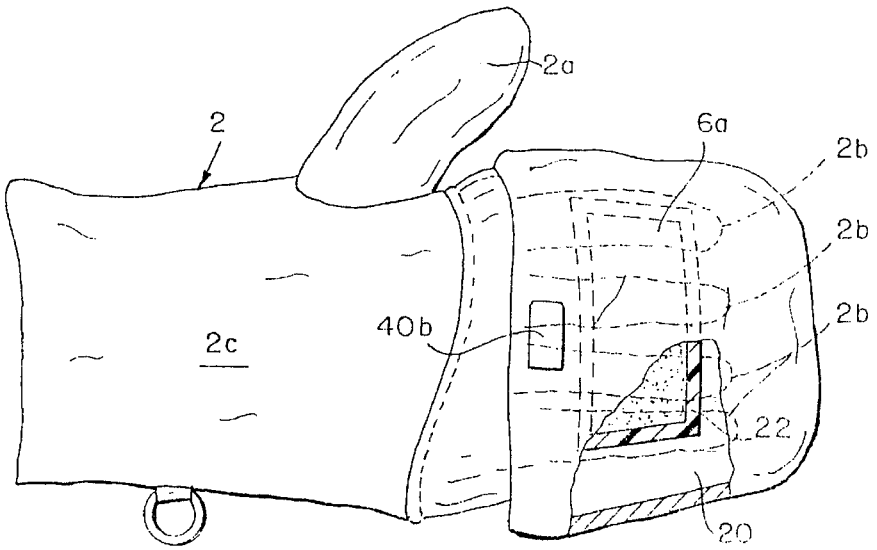

Referring first more particularly to FIGS. 1–3, the thermal glove of the present invention includes a glove body 2 having a thumb portion 2*a* and a plurality of finger portions 2*b* each of which completely encloses the associated finger. The glove body has an intermediate portion containing the hand-receiving chamber 4, which intermediate portion is provided with opposed palm and back portions 2*c* and 2*d*, respectively. The thermal glove also includes a cap member 6 that is connected with the glove member 2 by a flexible strip 8 that is stitched at one end to the back portion of the glove body by the line of stitching 10, and is stitched at its other end to the back portion 6*b* of the cap member 6 by a line of stitching 12. Preferably the flexible strip is formed of a resilient fabric material, although it could be formed of leather, or a suitable synthetic plastic material. The palm portion 6*a* and the back portion 6*b* of the cap member 6 define a chamber 14 that receives the finger portions 2*b* of the glove body portion 2. Sewn within the cap member 6 adjacent the palm portion 6*a* thereof is a fabric lining layer 18 that defines an internal pocket 20 that receives a conventional heating device 22, thereby to heat the finger portion 2*b* of the glove body 2. Cooperating separable fastener means 24*a* and 24*b* cooperate to retain the heating device 22 within the internal pocket 20 defined in the cap.

Figure 4:
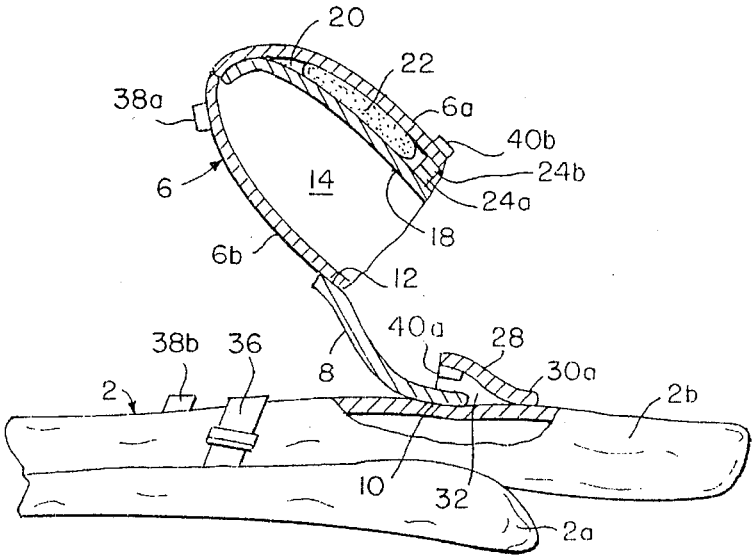
FIG. 4 illustrates the glove of FIG. 1 when the cap is displaced from the operative position of FIG. 1 toward the stored position.
Figure 5:
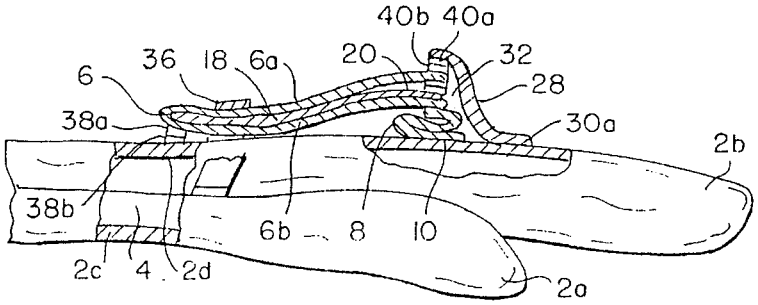
FIG. 5 illustrates the glove with the heating device removed and with the glove in the fully stored condition.
Figure 6:
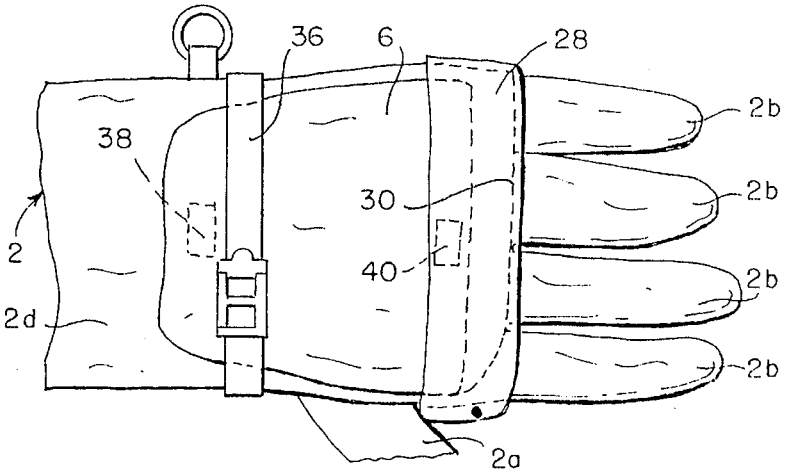
FIG. 6 is a top plan view of the glove of FIG. 5.

Referring now to FIG. 4, the cap member 6 is illustrated in an intermediate position removed from the finger portions 2*b* of the glove body 2 and partially displaced rearwardly toward the stored position of FIGS. 5 and 6. When the thermal glove is in the intermediate position shown in FIG. 4, the separable fastener means 24*a* and 24*b* arranged at the mouth of the interior pocket 20 may be separated for removal of the heating device 22 from the pocket 20. When in this intermediate condition, a glove strip 28 is exposed which is sewn to the glove body by transversely extending seam 30*a* and side seams 30*b* and 30*c* (FIG. 2), thereby to define a storage pocket 32.

When the cap 6 is completely displaced to the stored position of FIG. 5, the cap is inserted beneath the variable-length transversely extending retaining strap 36, and the free end of the cap is fastened to the back portion 2*d* of the body member 2 by separable fastener means (such as VELCRO fastener means, snap fasteners, cooperating tabs or the like) 38*a* and 38*b*, respectively. The flexible connecting strip 8 is compressed within the storage pocket 32 together with the portion of the cap member 6 containing the mouth region of the opening of heater pocket 20, as shown in FIG. 5. Separable fastener means 40*a* and 40*b* (such as VELCRO fastener means) fasten the free edge of the pocket-defining strip 28 with the palm portion 6*a* of the cap 6, whereby the portion of the cap containing the mouth of the heating pocket 20 is completely received within the storage pocket 32 and retained therein by the fastener means 40*a*, 40*b*. Thus, when the cap is in the stored position of FIGS. 5 and 6, the cap 6 is securely and protectively retained against the back portion of the thermal glove.

Figure 7:
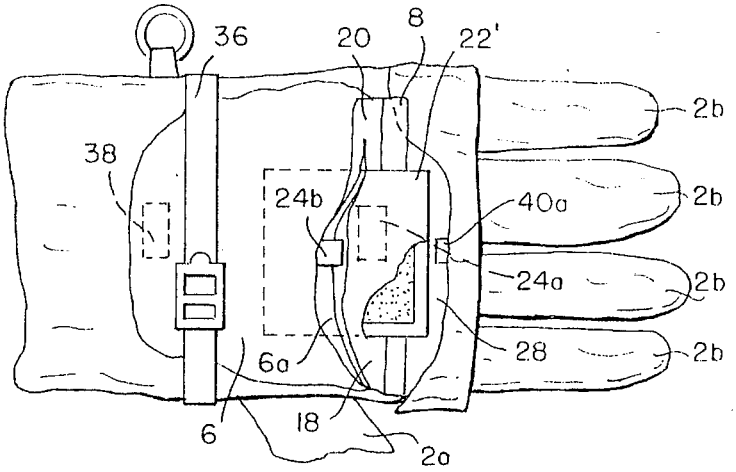
FIG. 7 illustrates the glove in the stored condition of FIG. 6 with the heating device being partially inserted within the heating pocket.

Referring now to FIG. 7, it is important to note that when the pocket-defining strip 28 is peeled back to open the fastener means 40 and the cap palm layer 6*a* is peeled back to unfasten the fastening means 24, the heater pocket 20 is opened, thereby to permit a new heating device 22' to be introduced within the heater pocket 20. After the heating device 22' has been completely inserted within the heater pocket 20, the fastener means 24*b* and 24*a* are closed to maintain the heating device within the heater pocket, and the fastener elements 40*a* and 40*b* are fastened together to close the storage pocket. The various illustrated VELCRO fastener means could be replaced by other types of cooperating fastener means, such as snaps, tabs and the like.

Figure 8:
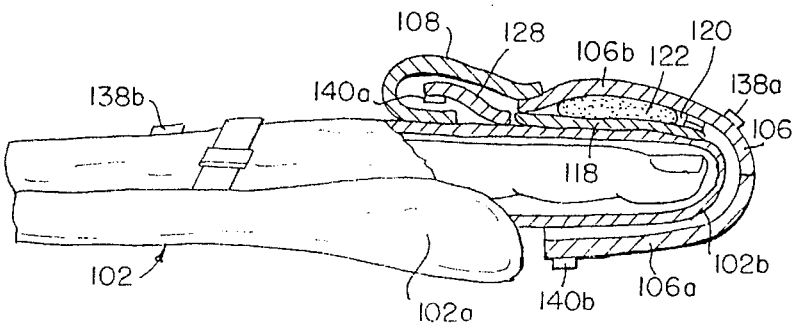
FIG. 8 is a partly sectional side elevational view of a modification of the glove of FIG. 1.

While in the embodiment of FIGS. 1–7, the heater pocket is formed on the palm portion 6*a* of the cap 6, is apparent that the heater pocket could also be formed on the back panel of the cap. Referring to FIG. 8, it will be seen that the inner liner layer 118 forms a heater pocket 120 adjacent the back panel 106*b* of the cap member 106, whereby the heating device 122 is arranged adjacent the knuckles of the wearer.

Preferably the heating device 122 is of the oxygen-activated chemical type, similar to the MEDIHEAT produced by the HEATMAX, Inc. of Dalton, Ga. Of course, other types of heating devices could be used as well, such as a microwaveable heater, electrically powered heating devices, or the like. Preferably the leather or synthetic plastic glove is of waterproof construction, whereby the user's fingers are continuously maintained in a dry condition (particularly during the heating thereof by the heating devices).

Figure 9:
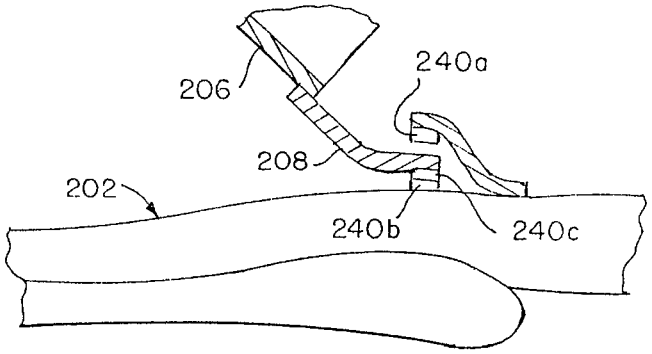
FIG. 9 is a detailed view of a modification of the embodiment of FIG. 1.

Referring to the embodiment of FIG. 9, the flexible connecting strip 208 is removably connected with the glove body 202 by suitable separable fastener means, such as cooperating Velcro strips 240*b*, 240*c*, snap fasteners, cooperating tabs, or the like.

While in accordance with the provisions of the Patent Statutes the preferred forms and embodiments of the invention have been illustrated and described, it will be apparent to those skilled in the art that those changes and modifications may be made without deviating from the inventive concepts set forth above.

What is claimed is:

1. A thermal glove including:

(a) a hollow glove body including a first end region having a thumb portion and a plurality of finger portions, an intermediate region containing a chamber and having opposed palm and back portions, and a second end region containing an opening through which a user inserts his hand into said chamber;

(b) a hollow cap containing a chamber and a cap opening communicating with said cap chamber, said cap having opposed palm and back portions:

(c) means including a flexible strip connecting said cap back portion with said glove body portion to permit displacement of said cap relative to said glove body between an operative position in which said cap chamber receives said glove finger portions via said cap opening and a stored position in which said cap is adjacent the back of the glove body portion with the back portions of the cap and glove being adjacent each other:

(d) means for retaining said cap in said stored position:

(e) means defining and interior heater pocket on one of the adjacent faces of said cap palm and back portions, said heater pocket containing a chamber having an opening for receiving a heating device, thereby to warm the finger portions of the glove body when said cap is in the operative position; and (f) means defining a storage pocket on said glove body back portion, said storage pocket containing a storage chamber and an opening facing away from said glove finger portions, said storage chamber being operable, when said cap is in said storage position, to receive via said storage pocket opening said flexible strip and the cap region containing the mouth of said cap opening.

2. A thermal glove as defined in claim 1, wherein said cap retaining means includes cooperating first separable fastener means on the back portions of said cap and said glove body, respectively.

3. A thermal glove as defined in claim 2, wherein said retaining means further includes variable-length strap means connected with said glove body back portion for extending across said cap when said cap is in said stored position.

4. A thermal glove as defined in claim 1, and further including second separable fastener means for releasably fastening together the palm and back portions of said cap adjacent the mouth of said cap opening, thereby to retain a heating device within the heater pocket.

5. A thermal glove as defined in claim 1, and further including means defining a storage pocket on said glove body back portion, said storage pocket containing a storage chamber and an opening facing away from said glove finger portions, said storage chamber being operable, when said cap is in said storage position, to receive via said storage pocket opening said flexible strip and the cap region containing the mouth of said cap opening.

6. A thermal glove as defined in claim 1, and further including cooperating third separable fastener means for fastening one wall portion of said storage pocket with said cap palm portion when said cap portion containing mid cap opening is received in said storage chamber.

7. A thermal glove as defined in claim 1, wherein said heater pocket is defined as said cap palm portion.

8. A thermal glove as defined in claim 1, wherein said heater pocket is defined on said cap back portion.

9. A thermal glove as defined in claim 1, wherein said flexible strip is resilient.

10. A thermal glove as defined in claim 9, and further including separable fastener means for removably connecting said flexible strip with said hollow glove body.

* * * * *